US010150636B2

(12) United States Patent
Blume et al.

(10) Patent No.: US 10,150,636 B2
(45) Date of Patent: Dec. 11, 2018

(54) STACKER DEVICE FOR FLAT ITEMS

(71) Applicants: Andreas Blume, Oranienburg (DE); Volker Harder, Bernau (DE)

(72) Inventors: Andreas Blume, Oranienburg (DE); Volker Harder, Bernau (DE)

(73) Assignee: Francotyp-Postalia GmbH, Berlin (DE)

( * ) Notice: Subject to any disclaimer, the term of this patent is extended or adjusted under 35 U.S.C. 154(b) by 0 days.

(21) Appl. No.: 15/819,108

(22) Filed: Nov. 21, 2017

(65) Prior Publication Data

US 2018/0105384 A1 Apr. 19, 2018

Related U.S. Application Data

(63) Continuation-in-part of application No. 15/375,328, filed on Dec. 12, 2016, now Pat. No. 10,011,452.

(30) Foreign Application Priority Data

Jan. 12, 2016 (DE) ..... 20 2016 100 099 U

(51) Int. Cl.
*B65H 31/02* (2006.01)
*B65H 31/12* (2006.01)
(Continued)

(52) U.S. Cl.
CPC ..... *B65H 31/02* (2013.01); *B65H 29/48* (2013.01); *B65H 31/12* (2013.01); *B65H 31/22* (2013.01); *B65H 31/34* (2013.01); *B65H 2301/161* (2013.01); *B65H 2301/4212* (2013.01); *B65H 2301/4219* (2013.01); *B65H 2404/5131* (2013.01); *B65H 2405/1115* (2013.01); *B65H 2405/1142* (2013.01); *B65H 2405/11152* (2013.01)

(58) Field of Classification Search
CPC ..... B65H 9/04; B65H 31/00; B65H 31/02; B65H 31/12; B65H 31/20; B65H 31/34; B65H 31/40; B65H 2402/343; B65H 2404/5131; B65H 2404/692; B65H 2404/72; B65H 2405/1115; B65H 2405/11152; B65H 2405/114; B65H 2405/1142; B65H 2405/33; B65H 2405/3311; B65H 2405/3312; B65H 2405/3521; B65H 2701/1916; B65H 29/48; B65H 2301/161; B65H 2301/4219
See application file for complete search history.

(56) References Cited

U.S. PATENT DOCUMENTS 3,937,456 A * 2/1976 Gruodis ..... B65H 3/44 271/278
4,322,068 A * 3/1982 Cayn ..... G06K 13/12 271/207

(Continued)

FOREIGN PATENT DOCUMENTS

JP 2012014621 A * 1/2012

*Primary Examiner* — Prasad V Gokhale
(74) *Attorney, Agent, or Firm* — Schiff Hardin LLP

(57) ABSTRACT

A stacker device in an items processing system is a last station of a mail line. The stacker device has a receiving plate to receive flat items, a longitudinal alignment wall, graduated in at least two steps, at a rear side of the stacker device, and a stop wall that is arranged at the downstream end of the receiving plate.

9 Claims, 4 Drawing Sheets

(51) Int. Cl.

| | |
|---|---|
| ***B65H 29/48*** | (2006.01) |
| ***B65H 31/34*** | (2006.01) |
| ***B65H 31/22*** | (2006.01) |

(56) References Cited

U.S. PATENT DOCUMENTS

| | | | | |
|---|---|---|---|---|
| 4,605,211 | A * | 8/1986 | Sonobe | B65H 31/34 227/100 |
| 5,188,353 | A * | 2/1993 | Parks | B65H 31/34 271/184 |
| 5,451,044 | A * | 9/1995 | Nakayama | B65H 29/26 271/189 |
| 2007/0057440 | A1* | 3/2007 | Feygelman | B65H 31/02 271/207 |
| 2010/0187744 | A1* | 7/2010 | Hirabayashi | B41J 13/106 270/52.09 |
| 2013/0038016 | A1* | 2/2013 | Inui | B65H 1/266 271/10.11 |

* cited by examiner

STACKER DEVICE FOR FLAT ITEMS

RELATED APPLICATION

The present application is a continuation-in-part of co-pending application Ser. No. 15/375,328, filed on Dec. 12, 2016.

BACKGROUND OF THE INVENTION

Field of the Invention

The invention concerns a stacker device for flat items of the type having a receiving plate on which the flat items accumulate in a stack, a stop wall that stops movement of the flat items through the stacker, and a longitudinal wall against which the accumulated items rest in the stack.

DESCRIPTION OF THE PRIOR ART

Stacker devices of the above type are used in items processing systems or as a last station of a mail line, for example. A mail line of a franking system is composed of individual mail processing stations arranged serially, and the flat items are mail pieces. At the start of the mail line, a placement station may be designed that serves to place individual or stacked mail pieces, which are transported downstream (in terms of mail flow), through additional stations until the end of the mail line, at the stacker device. A stack of mail pieces of different formats (mixed mail) that has been placed at the placement station is individualized in the mail line by an immediately following (in the transport direction) separator device of a feed station, since further following mail processing stations require individually supplied mail pieces. The stacker device for a flat good is provided for a use in connection with items processing devices that precede the stacker device, such as mail processing stations in connection with franking machines, addressing machines and other mail processing stations.

As used herein, the term "mixed mail" means mail pieces of similar format that differ within boundaries of up to 10% in height and width, for example letters of the B6 (12.5×17.6 cm) and C6 (11.4×16.2 cm) formats.

The term "stack" in the following means a letter stack, postcard stack, mail piece stack or other stacked articles or stacked items that can be individualized, and will be supplied lying on their sides.

In the field of franking machines, solutions are known that transport a mail piece downstream (in terms of mail flow) in the transport direction so as to print with a franking imprint during the transport. A device for transferring mail items to a stacker device is known from EP 985 619 B1. However, the intake quantity of mail pieces of the stacker device is marginal. The stacker device is unsuitable to accept a larger quantity of mail pieces in an ordered fashion.

A stacker device for a larger quantity of stacked mail pieces is described in the following using the term "stack box".

Such a box of smaller dimensions is known from JP 2000063026 A, for example. The base of the box is not inclined. A forward side wall can be opened like a door in order to remove the stack of mail pieces (postcards, for example). The problem of a high stack being at risk of tipping over exist for postcards of different formats, but not for postcards that are all of the same format.

In contrast, U.S. Pat. No. 6,648,284 B2 discloses an adjustment insert block within a items storage trough that has a base surface and a number of upright side walls that are connected with the base surface of the items storage trough. The adjustment insert block has a doubly inclined surface that produces an alignment of the stack of mail pieces at one corner of the items storage trough. A stack with mail pieces of different formats is thus also stored in an organized fashion in the items storage trough.

JP 2002234659 A discloses two wedge-shaped chamfers in the base of a box whose surface is inclined rearwardly, toward a guide wall, for the purpose of receiving paper sheets. A stop wall forms one end of the box that is directed downstream. In contrast to the start of the box, at the end of the box a guide wall protrudes into the region of flight paths of the paper sheets. A paper sheet on a maximum flight path therefore first strikes the guide wall and then falls onto the chamfers at the base of the box.

From U.S. Pat. No. 7,568,694 B2, a print medium collector is known that has a guide surface with an intake edge and an exit edge, wherein the guide surface is angled downwardly from the intake edge to the exit edge so that, when a printer releases an item to be printed that falls downwardly (due to gravity) over the exit edge onto the guide surface, and the item is moved with a leading edge of thereof within a region of flight paths, wherein each flight path has a downwardly directed and lateral component. A stop at the rear side of the print storage region may block a lateral movement of the item, so that such printed items are stored on a support surface against the stack, in order to form the stack. The aforementioned region of flight paths includes a maximum flight path in which the leading edge of the printed item is first contacts the stop and only afterward comes into contact with a printed item that is already lying on the support surface. The support surface is only slightly angled downwardly in the transport direction. The printed item collector is well suited for sheet-shaped print media of fixed length, but unsuited as a collector of mail pieces having differing formats (mixed mail).

From EP 1443008 B1, a device is known for receiving mail shipments in order to receive mail shipments that have been ejected via an exit slot of a folding and enveloping machine. The ejected mail shipments (which are stopped at a stop wall) collect on a support plate. Two side walls and one wall are designed to align these mail shipments again as soon as they have fallen onto the bearing plate. The wall has coupling means in order to enable a plugging of the receiving device onto the forward feed of a folding and enveloping machine. However, this receiving device is not entirely satisfactory because a uniform stack is not formed given a rapid ejection of mail pieces with identical format, due to an uncontrolled rebound.

In U.S. Pat. No. 8,590,888 B2, a storage device is described for storing mail pieces that are ejected from a franking machine out of an exit slot. The storage device has a receiving plate to receive mail pieces, a longitudinal alignment wall that extends across a longitudinal boundary of the receiving plate and perpendicular to the exit slot, on which the mail pieces strike before they collect on the receiving plate. The storage device has a vertical rear wall that extends along a lateral edge of the receiving plate, which the mail shipments meet before they strike against the longitudinal alignment wall. The vertical rear wall forms an angle $\beta$ relative to a perpendicular line relative to the longitudinal alignment wall. The receiving plate is inclined at an angle $\varphi$ relative to the horizontal and in the direction of the longitudinal alignment wall, such that the angle $\alpha$ between the receiving plate and the longitudinal alignment wall forms an acute angle of less than 90°. The longitudinal alignment wall is inclined at an angle Δ relative to the vertical direction and downwardly from the receiving plate. The production of the storage device is complicated because the bending of the longitudinal alignment wall over the longitudinal boundary of the receiving plate takes place with a curve, and all aforementioned angles α, β, Δ and φ are acute angles. Given a medium-speed ejection of mail shipments with differing formats (mixed mail), it is not guaranteed that a stack will be formed in an organized fashion, and cannot tip over. The stacks tend to tip over as of a specific height. The receiving plate has a boundary wall raised upwardly at the front side, but this is only effective for a very small stack height. The device is unsuited for the receiving and organized collection of mixed mail. Due to the curves at the receiving plate, mail pieces of different sizes cannot align themselves on an edge, in particular if the lowermost mail piece of the stack has a very small format. The placed mail pieces cannot always be removed without problems. The boundary wall that is raised at the front side interferes with the removal of the stack from the storage device. A predetermined piece count of mail pieces can in fact be franked and ejected via an adjustment to the franking machine. However, in the case of mixed mail, the removed stack may have a different stack height that is dependent on the thickness of the mail pieces. An additional disadvantage is that the mail pieces cannot be stacked to a desired stack height at which the stack can easily be grasped by hand.

SUMMARY OF THE INVENTION

An object of to achieve a stacker device for flat items, which does not have the aforementioned disadvantages.

A stacker device arranged at the end of the mail line, which is provided, for example, for a franking machine situated on a table top, should receive a larger quantity of flat items (mail pieces) having differing thickness and differing format (mixed mail) in an organized fashion.

A stacker device according to the invention has a receiving plate to receive flat items, a longitudinal alignment wall, graduated in at least two stages, at a rear side of the stacker device, and a stop wall that is arranged at the downstream end of the receiving plate.

Multiple flat items (such as letters and other mail pieces) that are lying on their side may be stacked in a stack. A front side of a receiving plate of the stacker device extends downstream and lies in a reference plane that the front side forms with a perpendicular line that is situated at the front side, parallel to a second perpendicular line that is perpendicular to the receiving plate. As soon as stack parts project through the reference plane, for mixed mail the risk exists that an instability of the stack will develop if the stack height continues to grow. It has been empirically found that, although that the stack leans against the longitudinal alignment wall, it cannot tip forward until reaching a specific stack height, and that the orientation and design of the longitudinal alignment wall performs a decisive function in an organized stacking. The stack height of partial stacks is limited by the graduated longitudinal alignment wall; the partial stacks are therefore stable. The stacking of a number of partial stacks atop one another is enabled by the inclination of the receiving plate, wherein the partial stacks lean against the longitudinal alignment wall due to the inclination. By an additional inclination of the receiving plate, an organized stacking of the stacks is enabled, which are aligned at the corner at which the longitudinal alignment wall and the stop wall meet.

DESCRIPTION OF THE PREFERRED EMBODIMENTS

Figure 1A:
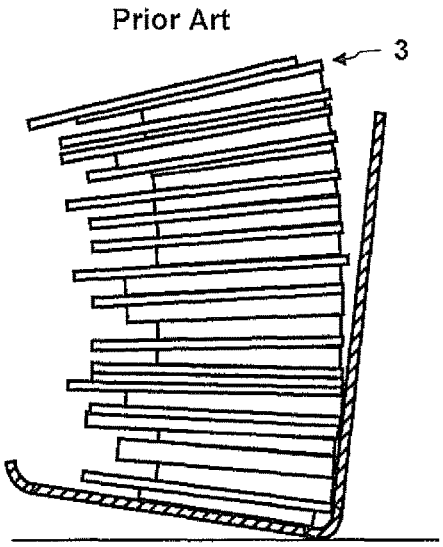
FIG. 1*a* is a schematic depiction of a stack box from the right, according to the prior art.

FIG. 1*a* shows a schematic depiction of a stack box from the right, according to the prior art, on which different flat items are stacked. The stack has grown beyond a reference plane at the front side and threatens to tip over, or the uppermost mail pieces 3 are at risk of sliding off the stack.

Figure 1B:
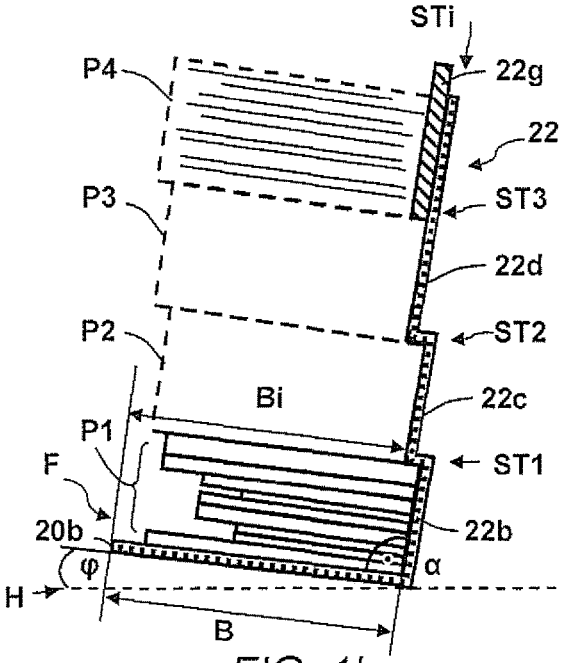
FIG. 1*b* is a schematic depiction of a stack box according to the invention, from the right, with graduation of the longitudinal alignment wall.

FIG. 1*b* shows a schematic depiction of a stack box from the right, with graduation of the longitudinal alignment wall 22. The angle α between the receiving plate and the longitudinal alignment wall 22 preferably forms a right angle. Running on the inside of the angle is a straight line with which the receiving plate and the longitudinal alignment wall meet, one after another, or at which the longitudinal alignment wall is bent away from the receiving plate. The aforementioned line at the longitudinal alignment wall 22 is designated in the following as a longitudinal boundary. The longitudinal alignment wall has vertical steps, wherein an edge 20*b* of the receiving plate that travels parallel to the longitudinal boundary is provided at a front side F of the stacker device, which edge 20*b* extends at a distance (spacing) B from the longitudinal boundary, wherein a distance Bi<B of the step from the reference plane results at the front side, which distance Bi<B is reduced per step with every step STi of the stepped longitudinal alignment wall. The distance B is the effective width of the receiving surface of the receiving plate for a stack. The receiving plate is inclined at the angle φ relative to horizontal H, and the longitudinal alignment wall 22 is inclined by the angle φ relative to a first perpendicular line S1. Shown at each step STi is a partial stack Pi, with Pi being one of P1, P2, P3, P4, wherein the partial stacks form the graduation. For i=1, a first step ST1 and a partial stack P1 result, which partial stack P1 rests on a first partial segment 22*b* of the longitudinal alignment wall 22 that extends beginning at the longitudinal boundary up to the level of the first step ST1. A second partial segment 22*c* of the longitudinal alignment wall 22 subsequently follows that extends up to the second step ST2. A third partial segment 22*d* of the longitudinal alignment wall 22 follows as of a third step ST3. At the upper edge of the longitudinal alignment wall, a plastic part 22*g* is attached that forms a fourth step ST4 and upper partial segment of the longitudinal alignment wall 22.

Figure 2A:
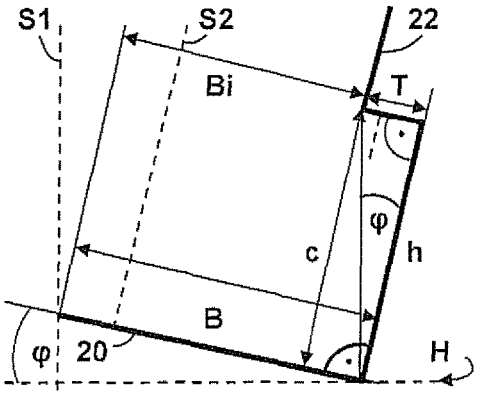
FIGS. 2*a* and 2*b* are schematic depictions of a stack box from the right, with a right angle and with graduation of the longitudinal alignment wall, with a first design and with an alternative design.

FIG. 2*a* shows a schematic depiction of a stack box according to the invention from the right, with graduation of the longitudinal alignment wall 22 according to a first embodiment variant. The first step ST1 is at a distance with the step height h from the longitudinal boundary. It is situated closer to the longitudinal boundary than the second step (not shown), which is separated at a distance of 2 h. An identical step height h and step depth T are preferably provided for each step. The distance B is reduced by a step depth T with each step i, with $$Bi=B-T \quad (1) \text{ and}$$

$$T=h\cdot\tan\varphi. \quad (2)$$

The step depth T results from an inclination of the receiving plate 20 in the direction of the longitudinal boundary of the longitudinal alignment wall 22, given inclination of the receiving plate by an angle φ relative to a horizontal H. The maximum stack height c of the first partial stack up to the first step is:

$$c=h. \quad (3)$$

The number of steps i (with i=1, 2, 3, . . . , n, . . . , u) is at least i=2, preferably n and at most i=u. The smallest letter format in Germany is C6 (11.4×16.2 cm). The step depth is therefore preferably in a range of T=1 to 7.5 cm, and for example is at T=1.44 cm. The step height is preferably in a range h=2T to 5T, and for example h=4T=6 cm. An angle φ of 15° results due to tan φ=T/h=1.44/6=0.24. For example, an angle φ of 23.3° results at T=2.3 cm and h=6 cm.

The longitudinal alignment wall is formed with vertical steps so that stacked, flat items lying on their side again reach a stop surface on the step underside as of a specific stack height. A (dashed) line perpendicular to the stop surface at the step underside is preferably situated parallel to a second perpendicular (dashed) line S2 that is situated perpendicular to the receiving plate. The uppermost of the flat items of the first stack has a slight positive engagement with the step underside, whereby the first stack receives an additional hold. The step depth T and/or step height h may be uniform for every step or decrease (the manner is not shown) with the step number.

Figure 2B:
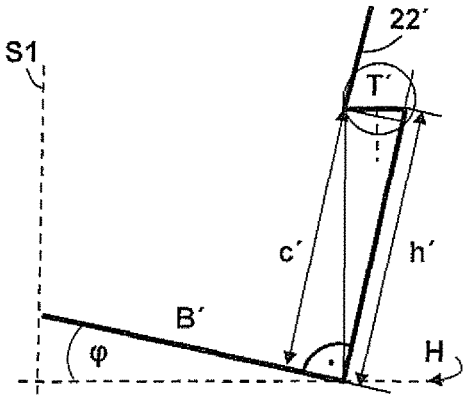

FIG. 2*b* shows a schematic depiction of a stack box according to the invention from the right, with graduation of the longitudinal alignment wall having an alternative design. A line perpendicular to the stop surface is parallel to a first perpendicular line S1 that is situated perpendicular relative to the horizontal H. The positive engagement of the respective uppermost flat stack good of the partial stack with the stop surface is thereby improved if an additional partial stack is resting on top. The stack height c' up to the first step remains the same as the stack height c' only the step height h is increased by Δh=T·tan φ to h', whereby the material consumption for the longitudinal alignment wall increases. A more acute angle is formed between the partial wall piece that determines the step depth T' and the partial wall piece that increases the step height h' by Δh.

Figure 2D:
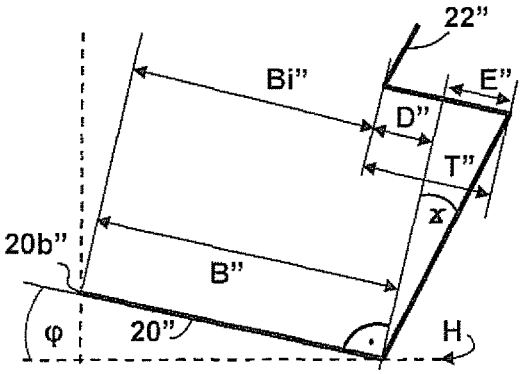
FIG. 2*d* is a schematic depiction of a stack box from the right, with an obtuse angle between the receiving plate and the longitudinal alignment wall, and with graduation of the longitudinal alignment wall.
Figure 2C:
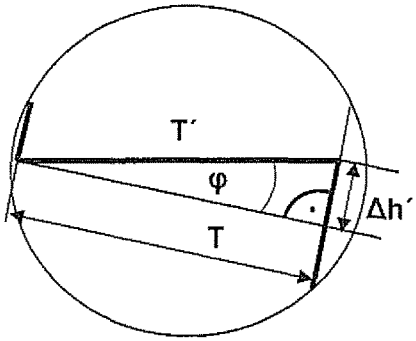
FIG. 2*c* shows a detail of FIG. 2*b*.

This detail arises from FIG. 2*c*. The step depth T' is in fact likewise increased relative to T, but only marginally by ΔT' (not shown). The increased material consumption for this is negligible.

In a further embodiment variant (not shown), the partial wall pieces for the step depth and the step height form an obtuse angle. That has the advantage that the arrangement of the respective uppermost flat stack good in the partial stack is improved.

In each step, the flat items lying flat on their sides may be aligned at the longitudinal alignment wall with their one edge ordered again. Via these steps it is ensured that the flat items of each stack rest more stably, and that each stack has a stack height that is uniformly within a predetermined range. A tipping forward of a first stack is also then prevented, although an additional stack of the next, following step rests, offset forward, on the surface of the first stack, since the uppermost of the flat items of the first stack has a slight positive engagement with the step underside, whereby the first stack receives an additional hold.

The advantage of a better removal of partial stacks results via graduation because the graduation forms in the partial stacks of the entire stack, and thus the partial stacks in the majority exhibit an approximately identical stack height. The entire stack does not need to be removed at once; rather, the removal may take place per partial stack from top to bottom.

Alternatively, the step height and step depth may be of variable design, without the fundamental function of the graduation being impaired. The longitudinal alignment wall is produced from metal, for example, preferably steel plate.

An additional advantage results via the possibility to further reduce the wall thickness of the longitudinal alignment wall, since the stability of the longitudinal alignment wall is improved by the graduation. The weight of the stack box is also thereby reduced, which is customer-friendly and cost-effective.

FIG. 2*d* shows a schematic depiction of a stack box from the right and with an obtuse angle between the receiving plate 20" and the longitudinal alignment wall 22", as well as with a graduation of the longitudinal alignment wall. As an alternative to the right angle, an obtuse angle α may be realized in order to increase the step depth. Given an obtuse angle α, the slight positive engagement with the step underside is likewise consequently improved, corresponding to the increase of the step depth.

Given an obtuse angle α=90°+ϒ up to the first step, the distance of the longitudinal alignment wall from the reference plane increases by E". Relative to the distance B" that an edge 20*b*" of the receiving plate 20 has from the longitudinal boundary at a front side F of the stacker device, the distance Bi" of the step from the reference plane decreases for smaller angles ϒ <φ given an increase of the step depth:

$$T''>T=h\cdot\sin\gamma \quad (5)$$

With each step, the distance B from the longitudinal boundary is reduced by a portion D" of the step depth T"=D"+E". It applies that:

$$Bi''=B''-D'' \quad (6)$$

Figure 3:
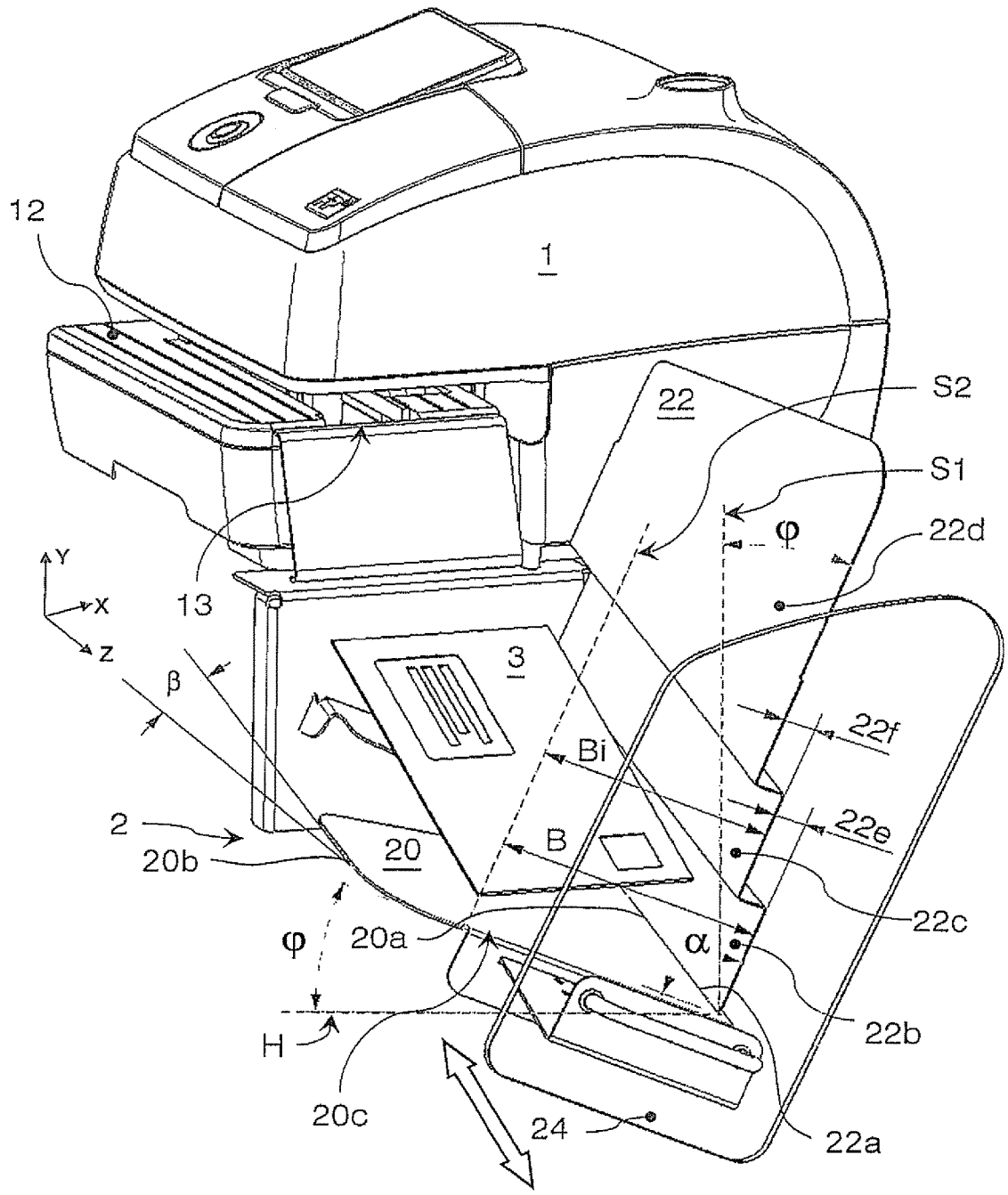
FIG. 3 is a perspective view of an items processing apparatus with a stack box for stacking flat items.

FIG. 3 shows a perspective depiction of a stacker device that connects to a items processing device which has an exit slot 13 for flat items and that may be fastened with a fastening device (the manner is not shown) to table top, wherein the stacker device has:

a receiving plate 20 to receive flat items 3 that have been ejected piece by piece via the exit slot 13, wherein the exit slot 13 extends at the end of a horizontal cover 12 of the items processing device, parallel to a horizontal line H, wherein—from the cover 12, downstream in the direction of the flight path of the ejected flat items, the receiving plate 20 is inclined downwardly at an angle β relative to the transport direction z of the flat items on the cover, and also is inclined rearwardly at an angle φ relative to the horizontal line H in a direction x relative to the graduated longitudinal alignment wall 22;

a longitudinal alignment wall 22 that is graduated in at least two steps n is arranged at a rear side of the stacker device 2, wherein the longitudinal alignment wall 22 extends downstream with a longitudinal boundary 22*a*, and is inclined at an angle φ relative to a first line S1 perpendicular to the horizontal line H, wherein the longitudinal boundary 22*a* travels at a distance B parallel to an edge 20*b* of the receiving plate 20 at a front side F of the stacker device, wherein the first perpendicular line S1 is perpendicular to the horizontal cover 12, and wherein a first stop surface 22*b* is arranged perpendicularly at an angle α=90°, or at an angle α greater than 90°, relative to the receiving plate 20.

a stop wall 24 that extends along a lateral edge 20*c* of the receiving plate 20.

The stop wall 24 is arranged at the downstream end of the receiving plate and is designed to as to be displaceable in the longitudinal direction (white arrow). Either the stop wall 24 travels parallel to a line perpendicular to the longitudinal alignment wall 22 and extends upwardly, parallel to the second line S2 that is perpendicular to the receiving plate 20, or the stop wall 24 is aligned perpendicularly to the cover 12 and extends in the y-direction, parallel to the first perpendicular line S1.

The stacker device 2 is arranged downstream of a items processing device; that a telescoping leg is arranged near the downstream end of the stacker device for additional support of the receiving plate 20; that the telescoping leg has an extensible foot and a head that is connected with the receiving plate so as to be detachable; that the head has, at the downstream end of the receiving plate, openings for a rail-like carrier on which the stop wall 24 is installed; and that the rail-like carrier is designed so as to be displaceable in the longitudinal direction. A fastening device is provided with which the stacker device may be fastened with its other end onto a table plate. The fastening device has brackets or bar clamps or comparable fastening elements (the manner is known).

The step depth T and/or the step height h is designed uniformly for each step, or decreasing with the step count. Alternatively, individual steps may also deviate from the uniform values of the dimensions.

As of the second step, the perspective depiction of a stacker device according to FIG. 3 shows a more than doubled height of the third partial segment 22*d* of the longitudinal alignment wall 22. At the upper end of the longitudinal alignment wall, a plastic part may be attached (the manner is not shown) that projects into the inner space of the stacker device in order to form a fourth step.

The angle α between the receiving plate 20 and the longitudinal alignment wall 22 is a right angle α in the depiction according to FIG. 3.

The following angle ranges are provided for the angles:

α=90° 120°,

β=2°-45° and

φ=2°-45°.

For example, the stacker device 2 is provided for operation at a franking machine, specifically for stacking mixed mail. The receiving plate 20 is comprised of a sheet metal plate that has an edge 20*c* at the stop side, wherein the sheet metal plate is bent downward at the edge 20*c*. Openings for a rail-like and extensible carrier are arranged in the bend, on which carrier the stop wall 24 is installed. The receiving plate 20 and the longitudinal alignment wall 22 are preferably produced from two sheet metal plates. The receiving plate 20 then exceeds the width B that is effective for a stacking up to a bend edge (not shown) that has a distance from the line 20*a*. The line 20*a* for its part has the distance B from the edge 20*b*. A longitudinal boundary 22*a* meets the longitudinal alignment wall 22 at the line 20*a* given an installation on the receiving plate 20.

Alternatively, the receiving plate 20 can have an effective width B from the edge 20*b* at the front side up to the longitudinal boundary 20*a* if the sheet metal plate is bent upwardly at the longitudinal boundary 20*a* and transitions into a longitudinal alignment wall 22.

In the preferred embodiment, the longitudinal alignment wall 22 has the following design or dimensions: metal plate with 1 cm thickness. Given a 275 cm length of the longitudinal boundary 22*a*, the downstream edge travels at an acute angle (of 74.9°, for example) into the longitudinal boundary 22*a* of the longitudinal alignment wall 22.

The steps proceed parallel to the longitudinal boundary 20*a*. The step height of the first partial segment 22*d* of the longitudinal alignment wall 22 is h=6.1 cm. The step height of the second partial segment 22*c* of the longitudinal alignment wall 22 is h=6.0 cm. The step height of the third partial segment 22*d* of the longitudinal alignment wall 22 is h=5.9 cm, given a plastic part 22*g* installed on the longitudinal alignment wall 22, the downstream edge of which plastic part 22*g* is 123.7 cm length. The upstream edge of the installed plastic part 22*g*, whose length L is approximately 13.7 cm, travels parallel to the downstream edge. The upstream edge of the metal plate is 24.5 cm long overall, and the downstream edge of the metal plate is 330 cm long overall. The upper edge is rounded at the corners and is only 26.1 cm overall, and travels parallel to the transport direction z of the mail piece 3 on the cover 12.

The stop wall 24 is composed of a transparent plastic, for example acrylic glass, having 6 cm thickness and 164 cm width. The height of the stop wall at the front side of the stacker device is at least 22.5 cm, and the height at the rear side is at most 33 cm. The corners of the stop wall 24 are rounded.

Figure 4:
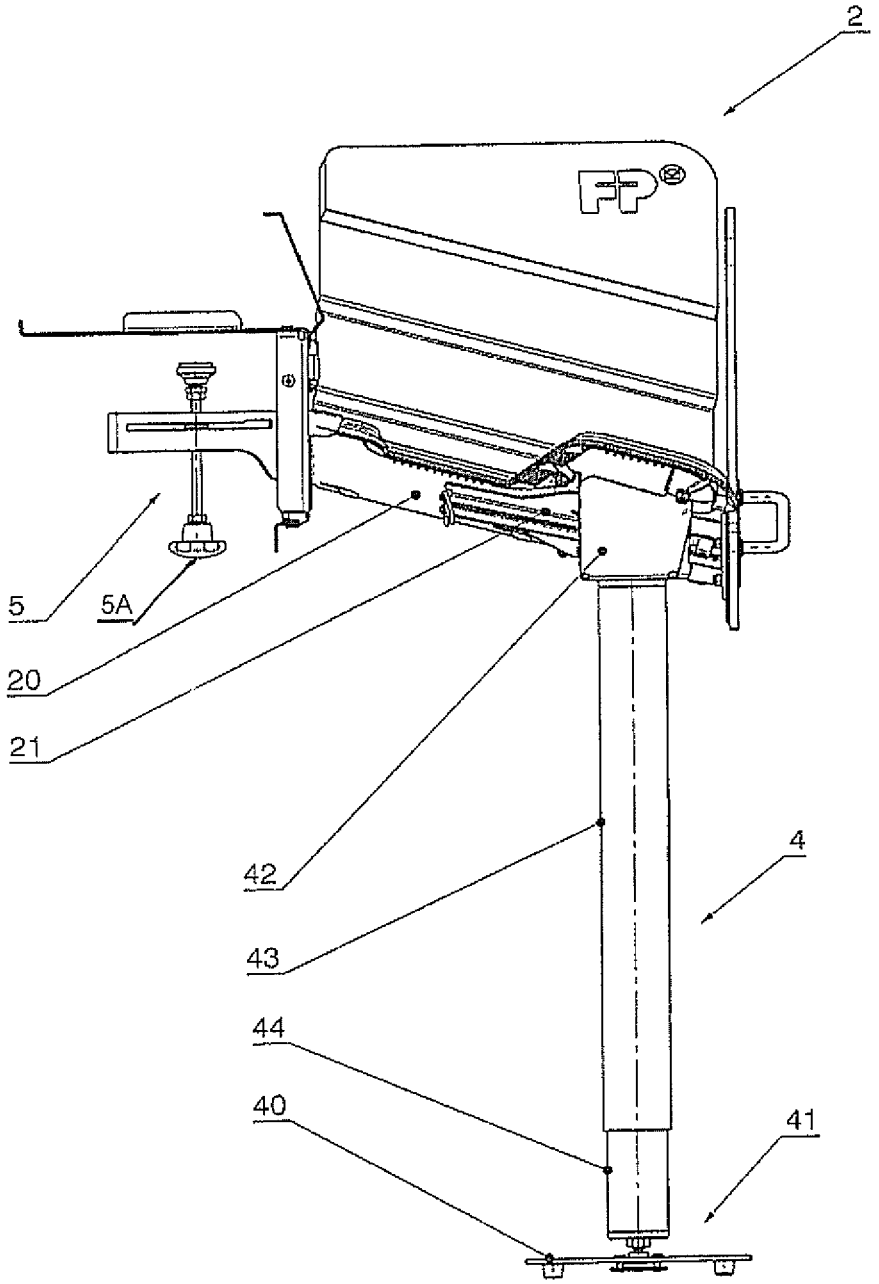
FIG. 4 is a side view of a stack box with telescoping leg, from the left.

FIG. 4 shows a side view of a stack box having a telescoping leg, from the left. It is likewise provided (not shown) that the stacker device 2 is arranged downstream of a goods processing device. A telescoping leg 4 is arranged near to a downstream end of the stacker device 2 for additional support for the receiving plate 20. The telescoping leg 4 has a head 42, a guide tube 43, a lower tube 44 and a foot 41. The head 41 is connected so as to be detachable with the receiving plate 20. At the downstream end of the receiving plate, the head 42 has openings 421, 422 (FIG. 6) for a rail-like carrier 21 at which the stop wall 24 is installed. The rail-like support 21 is designed so as to be displaceable in the longitudinal direction. The lower tube 44 is supported with its end in the guide tube 43 so as to be displaceable. At the other end of the lower tube 44, a foot plate 40 of the foot 42 is installed so that it can be bent, which foot plate 40 may therefore be adapted to arbitrary unevenness of the flooring. The lower tube 44 may be positioned firmly on the guide tube 43 in any extended state (the manner is not shown).

An attachment device 5 with which the stacker device 2 can be attached with its other end to a table plate is provided at the other end of the stacker device 2 that is situated upstream. The attachment device has brackets or a screw clamp 5A or comparable attachment means.

Figure 5A:
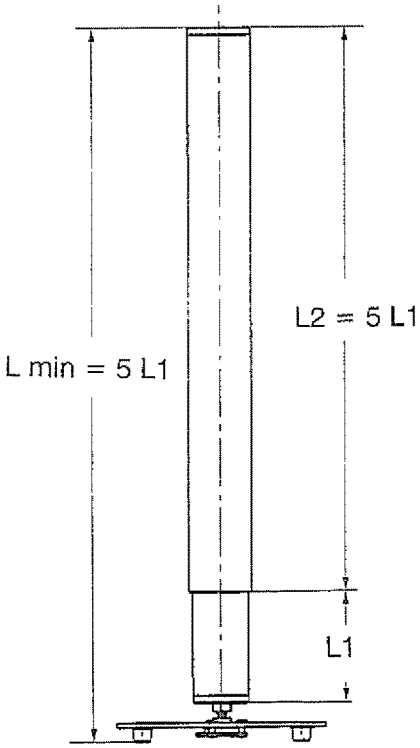
FIG. 5*a* is a view of a retracted telescoping leg.
Figure 5B:
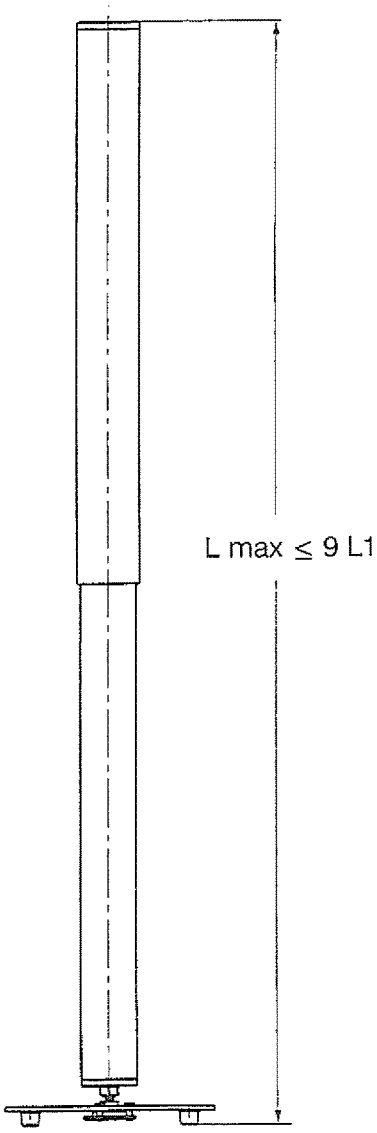
FIG. 5*b* is a view of an extended telescoping leg.

FIGS. 5*a* and 5*b* show a view of a retracted telescoping leg and an extended telescoping leg. The lower tube 44 can be slid into the guide tube 43 so far that only a part of the lower tube 44 having a length L1 protrudes from the guide tube 43. The guide tube 43 has a length L2=4 L1, for example. The minimum length of a retracted telescoping leg (FIG. 5*a*) therefore results as Lmin=5 L1. The extended telescoping leg (FIG. 5*b*) has a maximum length Lmax=9 L1, for example.

Figure 6:
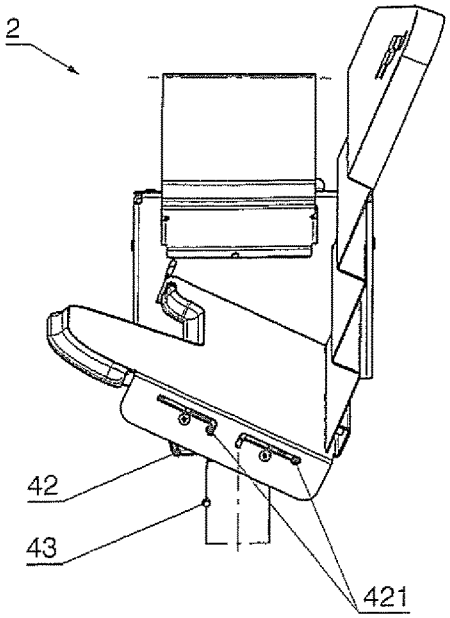
FIG. 6 is a side view of a head of the telescoping leg, from the right.

FIG. 6 shows a side view of a head of the telescoping leg from the right, with openings 421 and 422. The latter enable a guidance of a rail-like carrier 21 of the stop wall 24 upon its extension or retraction.

Although modifications and changes may be suggested by those skilled in the art, it is the intention of the Applicant to embody within the patent warranted hereon all changes and modifications as reasonably and properly come within the scope of the Applicant's contribution to the art.

The invention claimed is:

1. A stacker device comprising:

a receiving plate onto which flat items proceed in a longitudinal movement direction between an upstream end and a downstream end of said receiving plate;

an alignment wall proceeding along said longitudinal movement direction, said alignment wall being attached to and extending upwardly from said receiving plate;

a stop wall situated at said downstream end of said receiving plate that stops movement of said flat items and thereby causes said flat items to accumulate in a stack on said receiving plate, adjacent to said alignment wall;

said alignment wall having at least two steps therein that are stepped individually toward said flat items, each of said steps limiting an accumulated height of said flat items in said stack; and said receiving plate being situated downstream of an upstream device, and comprising a telescoping leg situated at said downstream end of said receiving plate that provides support to said receiving plate, said telescoping leg having an extensible foot and an extensible head that are connected with the receiving plate so as to be detachable, said extensible head being situated at the downstream end of the receiving plate and having openings for a rail carrier on which said stop wall is installed, said rail carrier being displaceable in said longitudinal movement direction, and said receiving plate comprising a fastener at said upstream end adapted to fasten said receiving plate to said upstream device.

2. A stacker device as claimed in claim 1 wherein said receiving plate and said alignment wall form an angle $\alpha$ therebetween, and:

said receiving plate is adapted to receive said flat items after said flat items are ejected, in a flight path, from an exit slot of an items processing device, said exit slot extending parallel to a horizontal line at an end of a horizontal cover of said items processing device, said items proceeding in said longitudinal movement direction in said flight path;

said receiving plate is inclined downwardly at an angle $\beta$ relative to said longitudinal movement direction, and being inclined rearwardly at an angle $\varphi$ relative to said horizontal line in a direction toward said alignment wall; and said alignment wall proceeds downstream, with a longitudinal boundary, inclined at said angle $\varphi$ relative to a first line that is perpendicular to said horizontal line, said longitudinal boundary proceeding parallel to, and at a distance B from an edge of the receiving plate at a front side of the receiving plate, and wherein one of said at least two steps forms a stack height stopping surface that is parallel to said receiving plate at least at said angle $\alpha$.

3. A stacker device as claimed in claim 2 wherein $\alpha=90°$.

4. A stacker device as claimed in claim 2 wherein $90° \geq \alpha \leq 120°$, and wherein said stop wall is displaceable in said longitudinal direction of movement.

5. A stacker device as claimed in claim 2 wherein said stop wall is perpendicular to said horizontal cover, and extends parallel to said first line.

6. A stacker device as claimed in claim 1 wherein each of said at least two steps of said alignment wall has at least one step attribute, selected from the group consisting of step depth and step height, that is uniform for each of said at least two steps.

7. A stacker device as claimed in claim 1 wherein each of said at least two steps has at least one step attribute, selected from the group consisting of step depth and step height, that decreases from step-to-step.

8. A stacker device as claimed in claim 1 wherein said stop wall is parallel to a line that is perpendicular to said alignment wall and extends upwardly, parallel to a further line that is perpendicular to said receiving plate.

9. A stacker device as claimed in claim 1 wherein said items processing device is a franking machine, and said flat items are mail pieces.

* * * * *